US012590499B2

(12) United States Patent
Hallundbæk

(10) Patent No.: US 12,590,499 B2
(45) Date of Patent: Mar. 31, 2026

(54) DOWNHOLE TUBING INTERVENTION TOOL

(71) Applicant: Welltec A/S, Allerød (DK)

(72) Inventor: Jørgen Hallundbæk, Zug (CH)

(73) Assignee: Welltec A/S, Allerød (DK)

( * ) Notice: Subject to any disclaimer, the term of this patent is extended or adjusted under 35 U.S.C. 154(b) by 580 days.

(21) Appl. No.: 17/244,209

(22) Filed: Apr. 29, 2021

(65) Prior Publication Data

US 2021/0340830 A1 Nov. 4, 2021

(30) Foreign Application Priority Data

Apr. 30, 2020 (EP) ..... 20172260

(51) Int. Cl.
*E21B 29/00* (2006.01)

(52) U.S. Cl.
CPC ..... *E21B 29/005* (2013.01)

(58) Field of Classification Search
CPC ..... E21B 29/002; E21B 29/005
See application file for complete search history.

(56) References Cited

U.S. PATENT DOCUMENTS 2,846,193 A 8/1958 Chadderdon
9,957,778 B2 5/2018 Jensen
2010/0122851 A1* 5/2010 Wilde ..... E21B 10/26 175/325.2
2013/0192830 A1* 8/2013 Watson ..... E21B 17/1078 166/55
2014/0124191 A1* 5/2014 Hallundbæk ..... E21B 29/00 166/55.2
2017/0145766 A1* 5/2017 Hart ..... E21B 29/005
2017/0350193 A1* 12/2017 Andersen ..... E21B 43/112

FOREIGN PATENT DOCUMENTS

WO 2012/164023 12/2012
WO 2017/171933 10/2017

OTHER PUBLICATIONS

Search Report for EP20172260.0, dated Sep. 16, 2020, 6 pages.

* cited by examiner

*Primary Examiner* — Tara Schimpf
*Assistant Examiner* — Lamia Quaim
(74) *Attorney, Agent, or Firm* — Nixon & Vanderhye P.C.

(57) ABSTRACT

The present invention relates to a downhole tubing intervention tool for submerging into a casing in a wellbore and for selectively removing material from within the casing, the tool extending in a longitudinal direction, comprising a tool housing having a first housing part and a second housing part, a rotation unit, such as an electrical motor, arranged in the second housing part, and a rotatable shaft rotated by the rotation unit for rotating at least a first segment of abrasive material being connected with the first housing part and forming an abrasive edge, wherein the first segment is movable between a retracted position and a projected position in relation to the first housing part of the tool housing.

19 Claims, 7 Drawing Sheets

DOWNHOLE TUBING INTERVENTION TOOL

Figure 1:
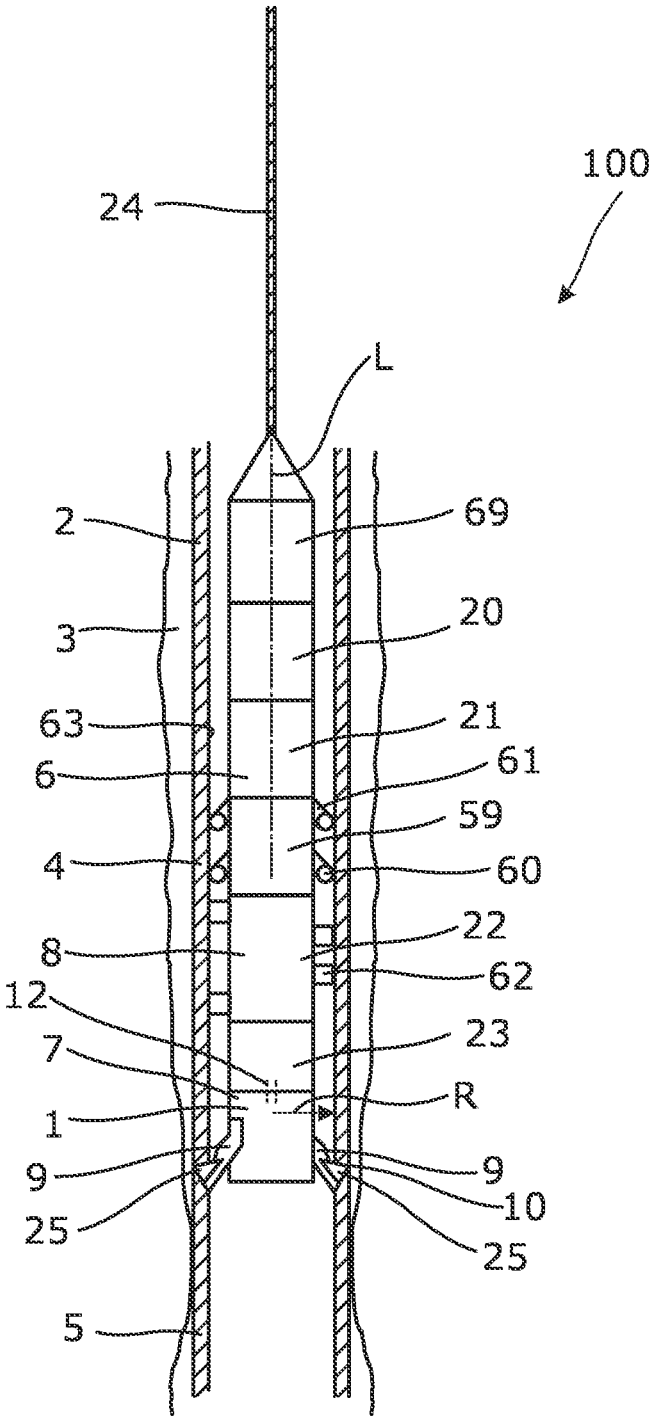

This application claims priority to EP Patent Application No. 20172260.0 filed 30 Apr. 2020, the entire contents of which is hereby incorporated by reference.

The present invention relates to a downhole tubing intervention tool for submerging into a casing in a wellbore and for selectively removing material from within the casing, the tool extending in a longitudinal direction.

After drilling, a borehole, a casing or a liner is run into the well by submerging the assembled string of a casing and completing the well. During completion, the casing may be stuck, and an upper part needs to be separated from a lower part to pull the upper part out of the well. During production or after production has stopped, a machining operation is needed in the well in order to remove a no-go, a nipple, a sliding sleeve, a valve, to cut to release a packer, to pull part of a casing or for providing a groove in a sliding sleeve or casing wall. Common for all these processes is that an intervention tool is submerged into the well; however, the known cutting tools sometimes fail to fulfil the operation as the cutting inserts are damaged before the job is done. Then the intervention tool needs to be pulled out, and the inserts need to be replaced to continue the operation, but since it may be very difficult to locate the exact former partial cut, the operation may fail again. Especially in large-diameter casings, the intervention tool seems to fail.

It is an object of the present invention to wholly or partly overcome the above disadvantages and drawbacks of the prior art. More specifically, it is an object to provide an improved downhole tubing intervention tool capable of removing or cutting an element downhole from within in one run also in large-diameter casings.

The above objects, together with numerous other objects, advantages and features, which will become evident from the below description, are accomplished by a solution in accordance with the present invention by a downhole tubing intervention tool for submerging into a casing in a wellbore and for selectively removing material from within the casing, the tool extending in a longitudinal direction, comprising:

- a tool housing having a first housing part and a second housing part,
- a rotation unit, such as an electrical motor, arranged in the second housing part, and
- a rotatable shaft rotated by the rotation unit for rotating at least a first segment of abrasive material being connected with the first housing part and forming an abrasive edge, wherein the first segment is movable between a retracted position and a projected position in relation to the first housing part of the tool housing.

When having large-diameter wells and the outer diameter of the tool is restricted by a restriction further up the casing than where the operation is to take place, the segment needs to be projected further out than in small-diameter casings, and then there will be a high risk that vibrations will knock off pieces of the segment during the machining operation for removing material, but when the segment is made of abrasive material new grains come forward and the removal operation can proceed.

In other situations, the downhole tubing intervention tool is submerged into a casing which is surrounded by a sleeve or a second casing, and the downhole tubing intervention tool needs to selectively remove material from within the casing to separate both the casing and the sleeve or the second casing. This is not possible if the separation of the first casing destroys the segment as then the segment cannot separate the second casing or the sleeve. However, when the segment is of an abrasive material which, when worn, merely reduces in size and new particles in the segment are exposed, the separation operation can easily proceed with success as the segment is merely projected a bit further for compensating for the reduced size of the segment.

Thus, the segment may be an abrasive segment.

Furthermore, the segment may be a grinding segment.

Also, the segment may be a grinding stone.

Additionally, the first segment of abrasive material may be a non-chip-producing material.

Further, the first segment may be made of a non-chip-producing material.

The first segment may be hydraulically movable between a retracted position and a projected position in relation to the first housing part of the tool housing.

By having a hydraulically operated part activation assembly, the segment can be projected continuously outwards as the segment is worn so that the size-reduced segment is still able to contact the casing, thus continuing the removal operation.

In addition, the tool may further comprise a gear section arranged between the rotation unit and the first housing part.

Moreover, the at least first segment of abrasive material may comprise grains of diamond or Cubic Boron Nitride, aluminium oxide (corundum), silicon carbide, tungsten carbide or ceramic.

Further, the downhole tubing intervention tool may comprise a second segment arranged at a distance from the first segment along a circumference of the tool.

Also, the at least first segment of abrasive material may comprise a binder, such as iron, cobalt, nickel, bronze, brass, tungsten carbide, ceramic, resin, epoxy or polyester.

Furthermore, the first segment may have a base part and a projecting part projecting from the base part, forming a radial tip.

In operation, the radial tip contacts the casing for selectively removing material from the casing, e.g. for separating the casing, and when the segment of an abrasive material is worn during the removal operation, the projecting part of the segment is merely reduced in size and new particles in the segment are exposed, thus the separation operation can easily proceed with success as the remaining part of the projecting part of the segment is merely projected a bit further for compensating for the reduced size of the segment. When separating a sleeve or a second casing surrounding the first casing, the base part also becomes abrasive, removing further material from the first casing so that the projecting part having separated the first casing can project further to also separate the second casing.

Additionally, the first segment may taper from a base part into a terminal end, forming a radial tip.

Moreover, the first segment may taper from a base part into a terminal end, forming a radial tip of the projecting part.

Thus, the base part, the radial tip and the projecting part may be of abrasive material.

Furthermore, the radial tip may form the abrasive edge.

In addition, the first segment may have a segment length along the longitudinal axis in the retracted position and a segment height perpendicular to the longitudinal axis, the radial tip having a tip length along the longitudinal axis being less than 75% of the segment length, preferably less than 60% of the segment length, and more preferably less than 50% of the segment length.

Further, the segment may have a first segment height at the base part and a second segment height at the radial tip, the second segment height being higher than the first segment height; preferably the second segment height is at least twice as high as the first segment height, and more preferably the second segment height is at least three times as high as the first segment height.

Moreover, the first segment may have a segment width extending along the circumference of the tool.

Furthermore, the segment width may be constant along the segment length.

Also, the segment width may be constant along the segment height.

In addition, the segment width may be smaller at the terminal end than at the base part.

Moreover, the radial tip may have a front face facing away from the second tool housing and a back face facing the second tool housing, and the front face may incline from the terminal end inwards so that the terminal end of the radial tip is the outermost part of the segment.

The segment may have a base face facing the first tool housing and facing away from the terminal end, and the segment may have an angle between the base face and the front face of more than 90°. In this way, the radial tip is more acute than if the front face did not incline inwards or backwards towards the back face.

Also, the tool may further comprise a projection part movable between a retracted position and a projected position in relation to the first housing part of the tool housing, the projection part having a first end and a second end, the second end being movably connected with the first housing part, and the first end being connected with the first segment, and the tool may further comprise a part activation assembly for moving the projection part between the retracted position and the projected position.

Moreover, the projection part may have several segments connected to the first end.

Additionally, the projection part may have a part extension, the segment length of the first segment extending along the part extension, and the segment height extending perpendicularly to the part extension in a radial direction of the tool.

Furthermore, the projection part may pivot between the retracted position and the projected position.

Also, the part activation assembly may comprise:

- a piston housing arranged in the first housing part and comprising a piston chamber, and
- a piston member arranged inside the piston chamber for moving the part between the retracted position and the projected position, the piston member being movable in the longitudinal direction of the downhole tool and having a first piston face, the piston member being capable of applying a projecting force on the part by applying hydraulic pressure on the first piston face and moving the piston in a first direction.

By having a hydraulically operated part activation assembly, the segment can be projected continuously outwards as the segment is worn so that the size-reduced segment is still able to contact the casing with sufficient weight on bit (WOB), continuing the removal operation.

In addition, the part activation assembly may comprise:

- a piston housing arranged in the first housing part and comprising a piston chamber, and
- a piston member arranged inside the piston chamber for moving the projection part between the retracted position and the projected position, the piston member being movable in a direction perpendicular to the longitudinal direction of the downhole tool and having a first piston face, the piston member being capable of applying a projecting force on the part by applying hydraulic pressure on the first piston face and moving the piston in a first direction.

Further, the downhole tubing intervention tool may be a downhole tubing separation tool separating an upper part of the casing from a lower part of the casing by abrasively machining the casing from within.

Moreover, the downhole tubing intervention tool may further comprise an anchor section comprising at least one anchor extendable from the tool housing for anchoring the tool in the casing.

In addition, the downhole tubing intervention tool may further comprise a driving unit comprising wheels on wheel arms for propelling the tool forward in the well.

Furthermore, the downhole tubing intervention tool may also comprise a stroking unit, such as a stroking tool, providing a movement of the first segment in the projected position along a longitudinal extension of the well tubular metal structure. Thus, when the downhole tubing intervention tool is submerged into the well tubular metal structure, and the anchor section of the downhole tool is hydraulically activated to anchor the non-rotating part of the downhole tubing intervention tool in relation to the well tubular metal structure, the first segment removes, e.g. by milling or grinding, material from the well tubular metal structure along the circumference and the longitudinal extension of the well tubular metal structure. Thereby, a section of the well tubular metal structure is removed from the well tubular metal structure by grinding the well tubular metal structure into small particles, creating or re-creating annular isolation.

The section removed from the well tubular metal structure may have a length along the longitudinal extension of the well tubular metal structure of more than 0.5 metre, preferably more than 1 metre, and even more preferably more than 5 metres.

Finally, the invention also relates to a downhole system comprising a well tubular metal structure and the above-mentioned downhole tubing intervention tool for arrangement in the downhole system.

Figure 2:
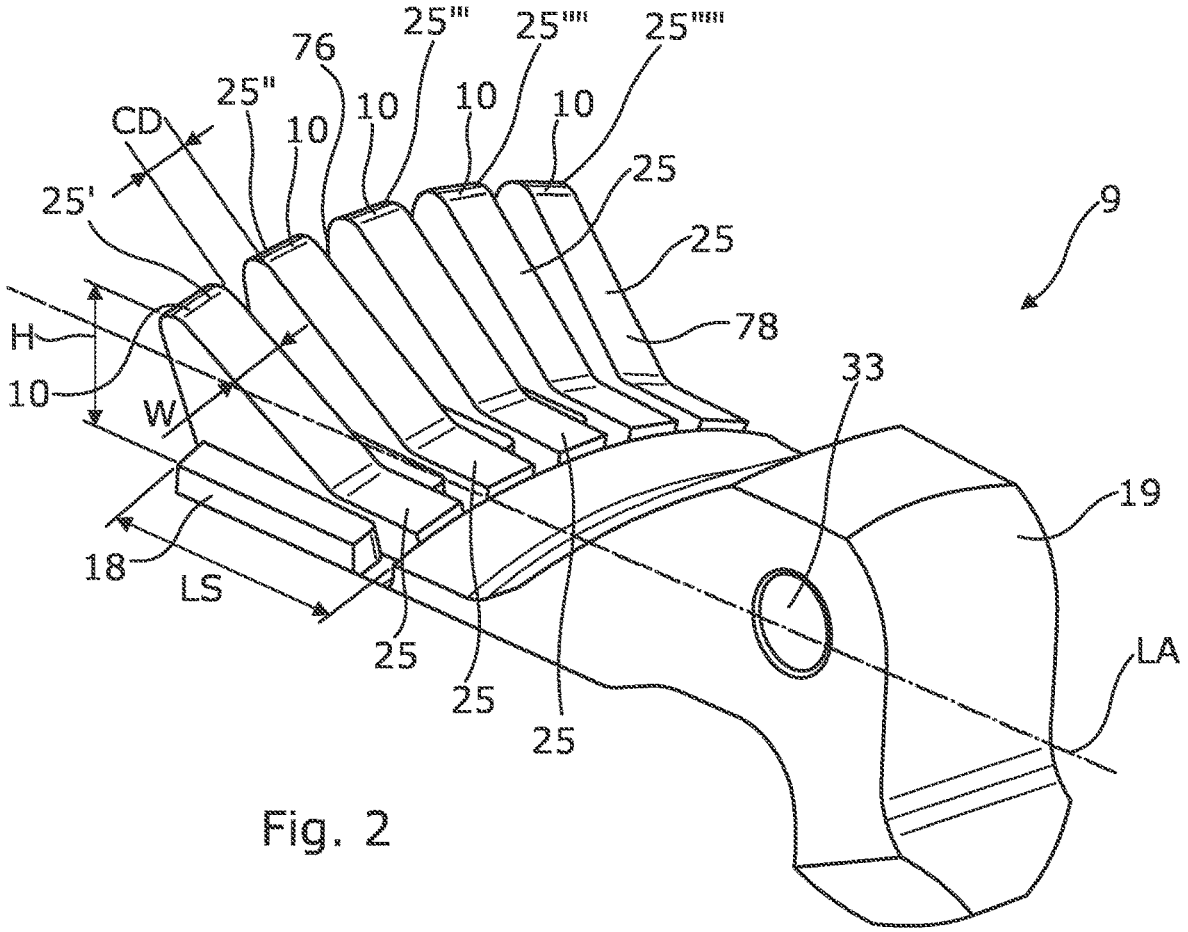
Figure 3:
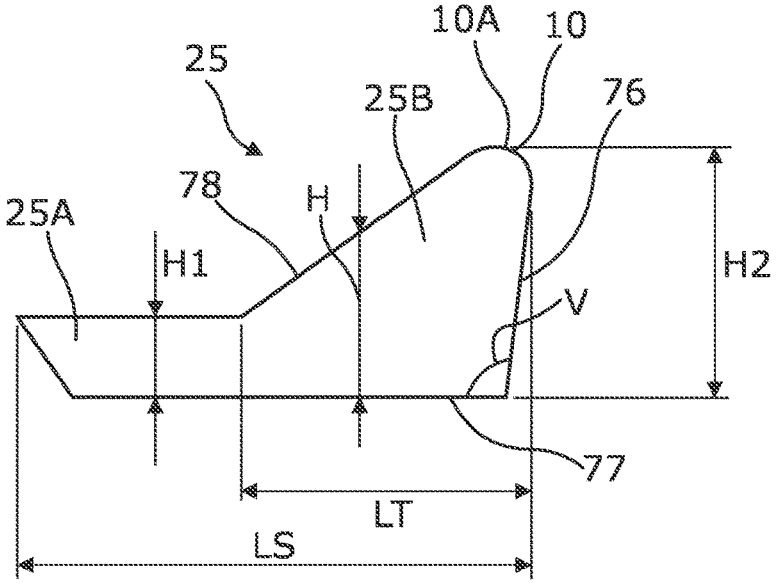
Figure 4:
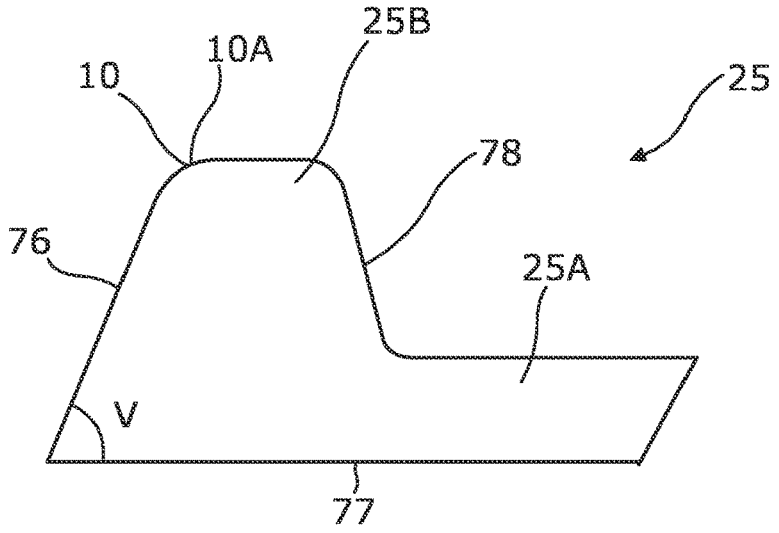
Figure 5:
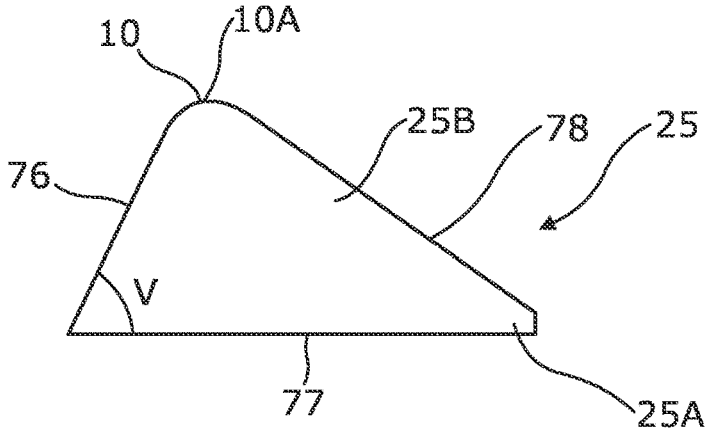
Figure 6:
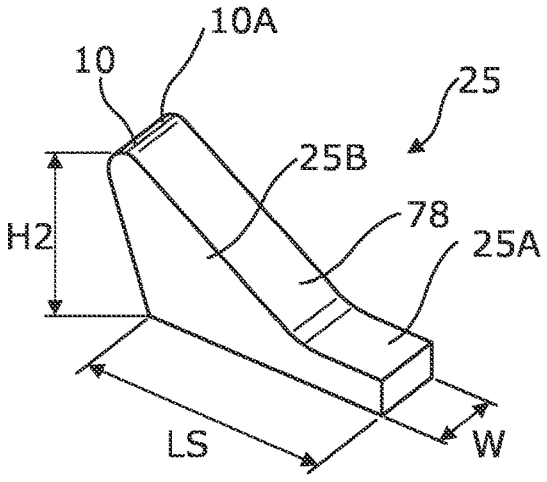
Figure 7:
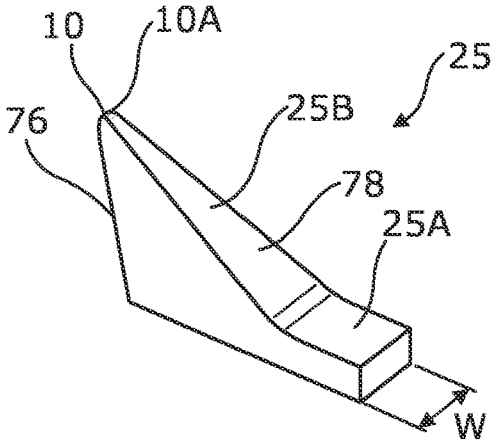
Figure 8:
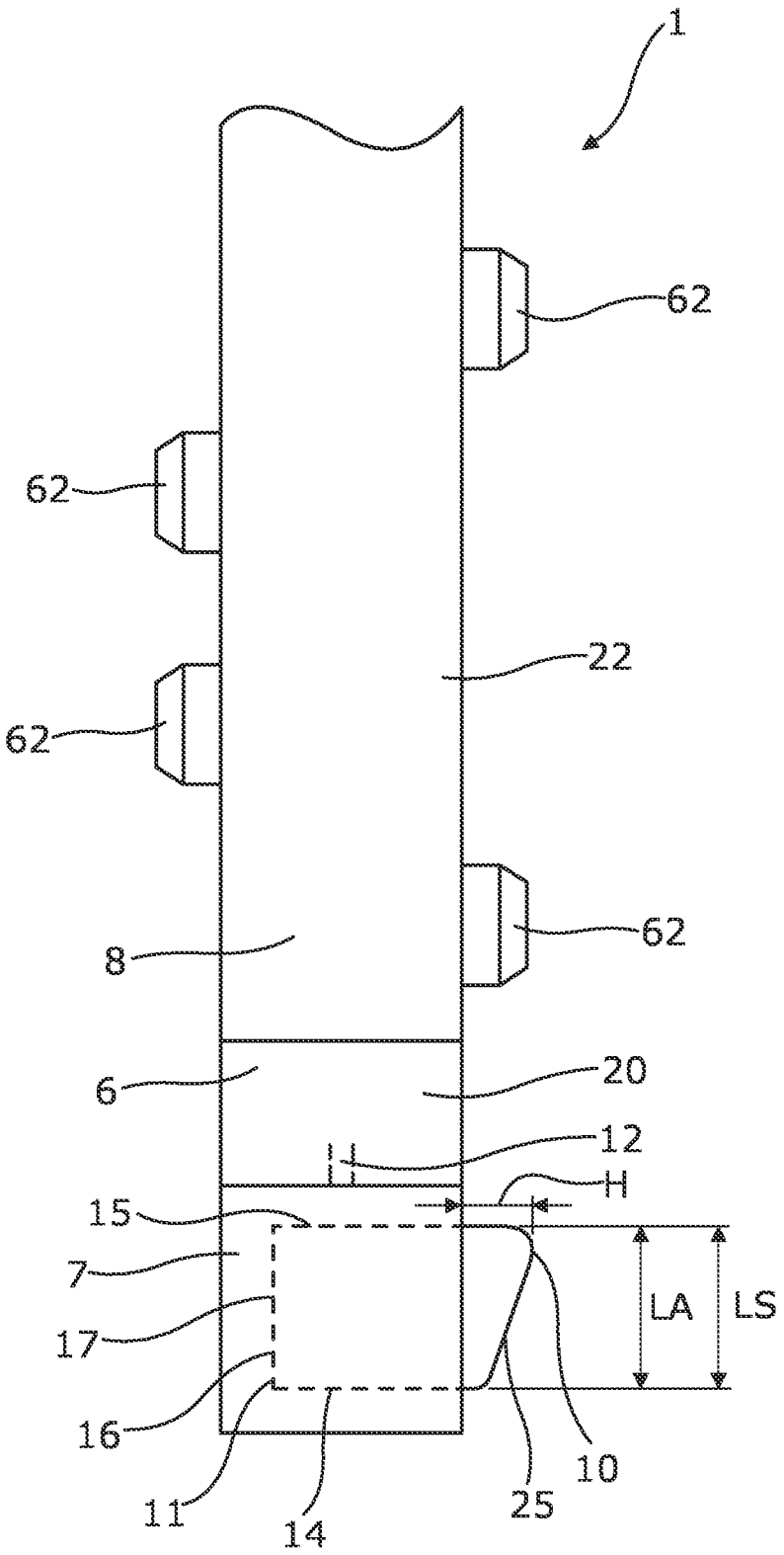
Figure 9:
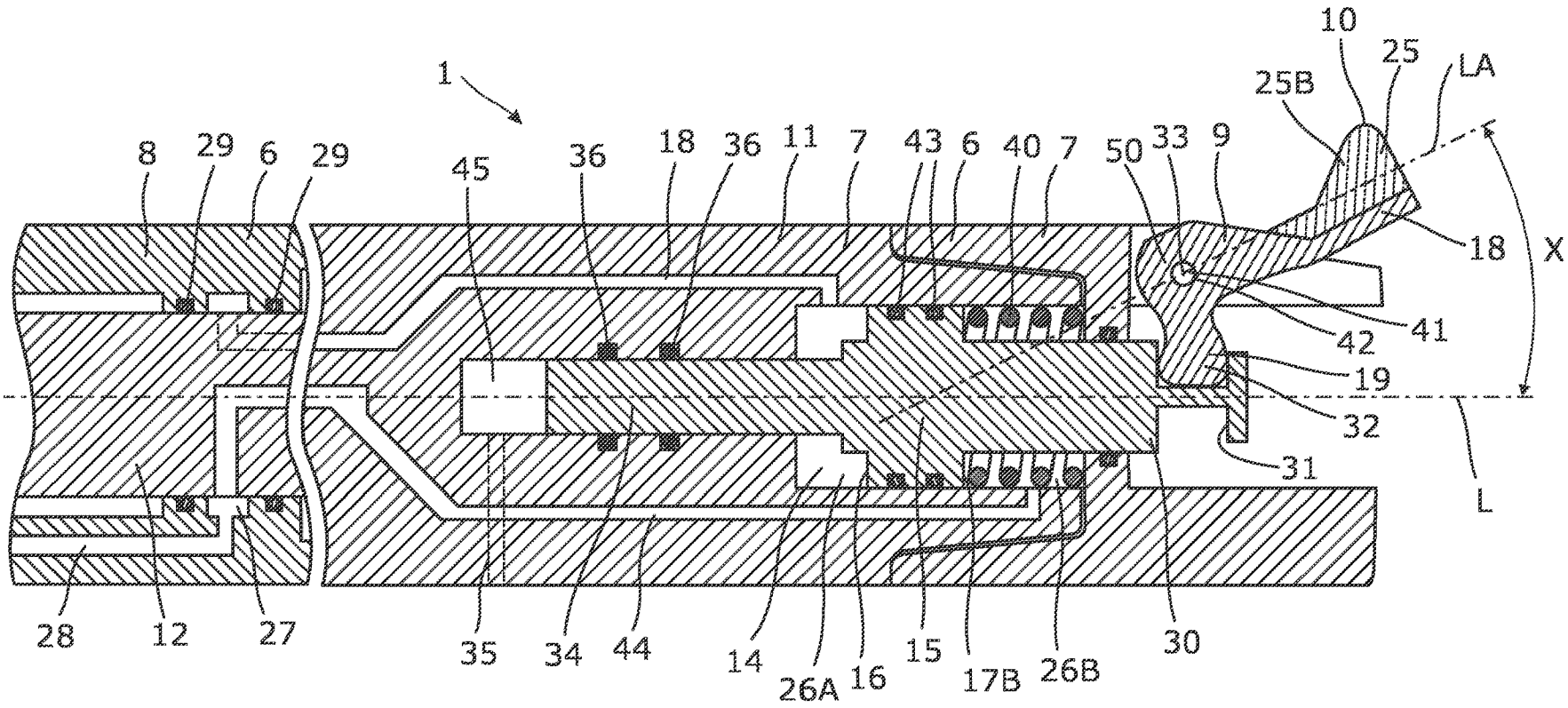
Figure 10:
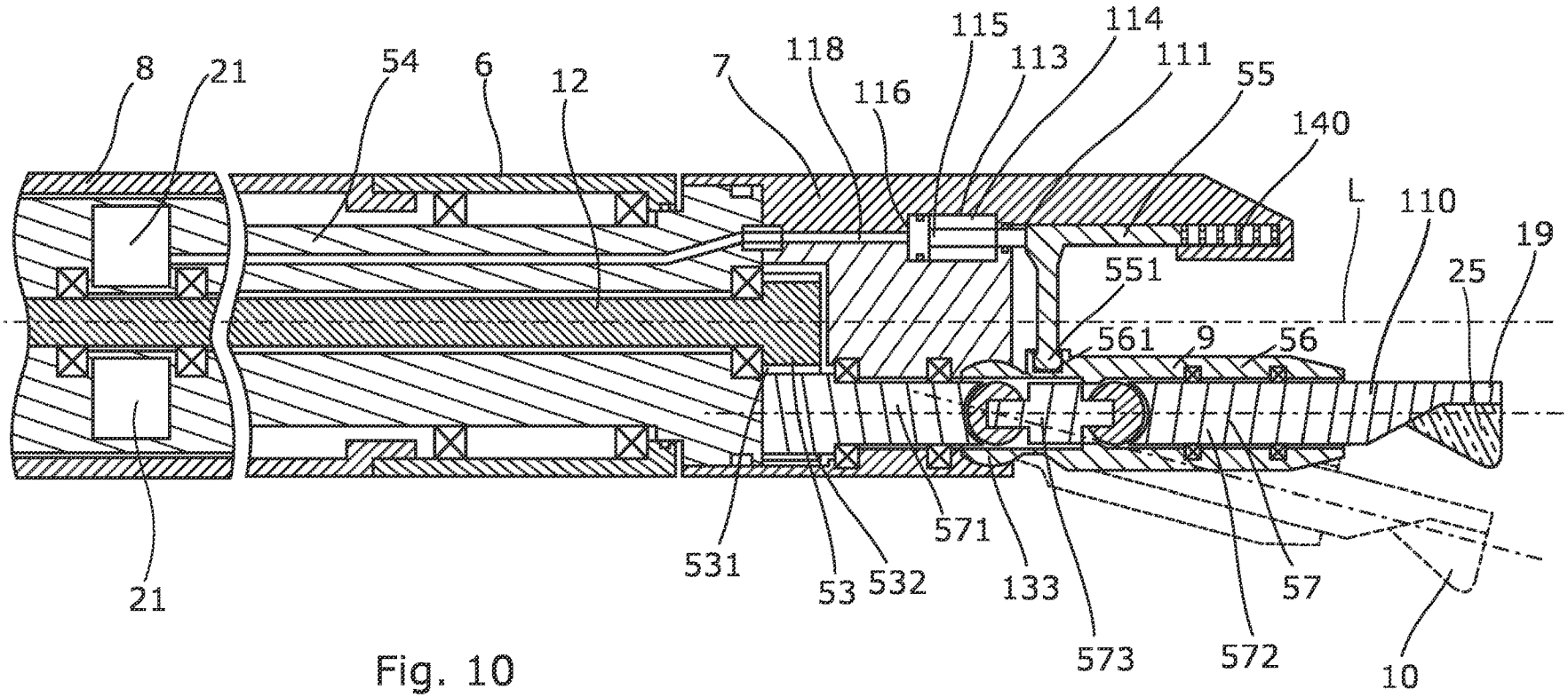
Figure 11:
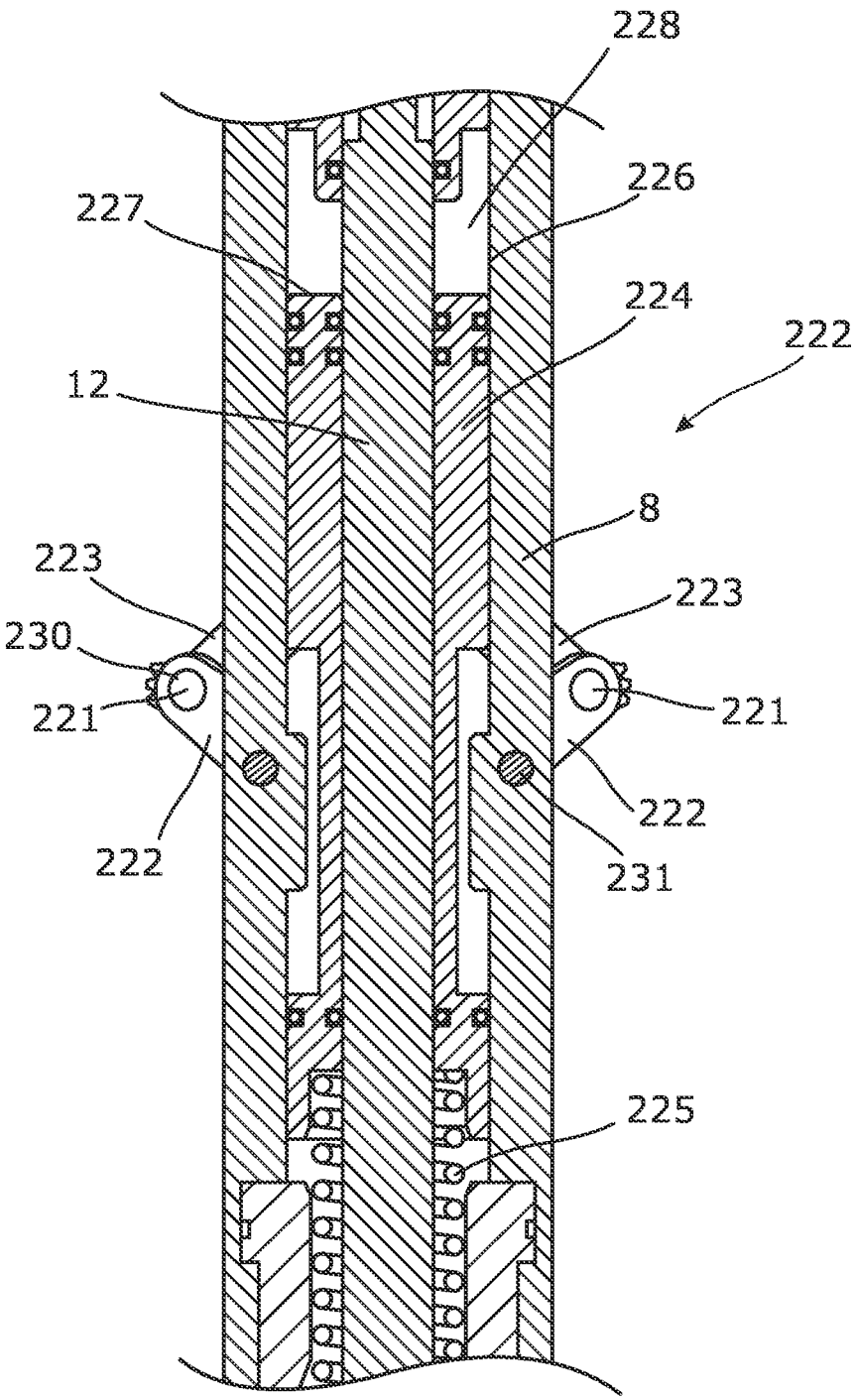

The invention and its many advantages will be described in more detail below with reference to the accompanying schematic drawings, which for the purpose of illustration show some non-limiting embodiments and in which:

FIG. 1 shows a partial cross-sectional view of a downhole tubing intervention tool in a casing in a wellbore for separating an upper part of the casing from a lower part of the casing by abrasive machining of the casing from within, FIG. 2 shows a projection part having a plurality of segments, FIG. 3 shows a side view of a segment of the downhole tubing intervention tool, FIG. 4 shows a side view of another segment of the downhole tubing intervention tool, FIG. 5 shows a side view of yet another segment of the downhole tubing intervention tool, FIG. 6 shows a perspective of one of the segments of the projection part of FIG. 2, FIG. 7 shows a perspective of yet another segment of the downhole tubing intervention tool, FIG. 8 shows a part of yet another downhole tubing intervention tool, FIG. 9 shows a cross-sectional view of a part activation assembly, FIG. 10 shows a cross-sectional view of another part activation assembly, and FIG. 11 shows a cross-sectional view of an anchoring section of the tool.

All the figures are highly schematic and not necessarily to scale, and they show only those parts which are necessary in order to elucidate the invention, other parts being omitted or merely suggested.

FIG. 1 shows a downhole tubing intervention tool 1 for submerging into a casing 2 in a wellbore 3 and for selectively removing material from within the casing, e.g. for separating an upper part 4 of the casing from a lower part 5 of the casing by abrasive machining of the casing from within. The tool extends in a longitudinal direction L and comprises a tool housing 6 having a first housing part 7 and a second housing part 8. The second housing part is arranged closer to the top of the well when the tool is submerged into the well. The tool further comprises a rotation unit 20, such as an electrical motor, arranged in the second housing part 8 and a rotatable shaft 12 rotated by the rotation unit for rotating at least a first segment 25 of abrasive material being connected with the first housing part 7 and forming an abrasive edge 10. The first segment is movable between a retracted position and a projected position in relation to the first housing part of the tool housing 6 so that the segment moves in a radial direction R and contacts the inner face of the casing. As can be seen, the tool comprises a plurality of segments.

The first segment is movable between a retracted position and a projected position by means of hydraulics/hydraulic power. By having a hydraulically operated part activation assembly, the segment can be projected continuously outwards as the segment is worn so that the size-reduced segment is still able to contact the casing with enough weight on bit (WOB), continuing the removal operation.

The downhole tubing intervention tool 1 further comprises a gear section 23 arranged between the rotation unit 20 and the first housing part 7 for changing the rotation of the rotational shaft so that the first housing part rotates at a lower or higher speed. The downhole tubing intervention tool 1 is a wireline tool, i.e., the tool receives power through a wireline 24. An electric control unit 69 is arranged between the connection to the wireline and a motor of the tool. The electrical motor both powers the pump and rotates the first housing part 7 and the segment. Even though not shown, the downhole tubing intervention tool 1 may have another motor besides the rotation unit 20, so that one motor drives a pump 21 and another rotates the first housing part 7 and the segment. The downhole tubing intervention tool 1 may further comprise a driving unit 59, such as a downhole tractor comprising wheels 60 on wheel arms 61, for propelling the tool forward in the well in other parts of the well than in the vertical part. The downhole tubing intervention tool 1 is submerged into the well or casing only by the wireline, e.g. with another kind of power supply line, such as an optical fibre, and not by tubing, such as coiled tubing, drill pipe or similar piping.

As shown in FIG. 1, the segment 25 abuts the inner face 63 of the casing 2 in order to selectively remove material from within the casing and separate the casing by machining into the casing by abrasive cutting, i.e. grinding, by forcing the segment 25 against the inner face while rotating the segment and thereby providing a circumferential cut of removed material by means of a non-chip-producing operation. Thereby, the removed material of the casing is only transformed into small particles and not a long chip as is the case with the known cutting tools. It is very difficult to bring such long chips left in the well to the surface, but these chips may be large enough for interacting with intervention tools or completion products later on.

When using a segment of abrasive material instead of known metal cutting inserts, unintended vibrations do not hinder the machining operation from finishing. When experiencing unintended vibrations, the known metal cutting inserts are damaged as the cutting edge hits against the casing and small fragments are knocked off, and the metal cutting inserts no longer have a cutting edge able to cut, and the tool needs to be retracted from the well. When having a segment of abrasive material, small knocked-off fragments will just expose new abrasive grains in the abrasive material, and the grinding process can continue. The segment thus mills or grinds into the element to be removed from the well, e.g. part of the casing wall, a nipple, a sliding sleeve, a no-go, a valve, etc.

In other situations, the downhole tubing intervention tool is submerged into a casing which is surrounded by a sleeve or a second casing, and the downhole tubing intervention tool needs to selectively remove material from within the casing to separate both the casing and the sleeve or the second casing. This is not possible if the separation of the first casing destroys the segment as then the segment cannot separate the second casing or the sleeve. However, when the segment is of an abrasive material which, when worn, merely reduces in size and new particles in the segment are exposed, the separation operation can easily proceed with success as the segment is merely projected a bit further for compensating for the reduced size of the segment.

The segment may be an abrasive segment or a grinding segment, such as a grinding stone. The first segment of abrasive material is a non-chip-producing material. Thus, the first segment is of a non-chip-producing material.

The segment 25 of abrasive material comprises grains of diamond or Cubic Boron Nitride, aluminium oxide (corundum), silicon carbide, tungsten carbide, ceramic or similar material. The first segment of abrasive material comprises a binder, such as iron, cobalt, nickel, bronze, brass, tungsten carbide, ceramic, resin, epoxy or polyester.

As shown in FIGS. 3 and 6, the segment tapers from a base part 25A into a terminal end 10A, forming a radial tip 25B. The first segment 25 has a segment length LS along the longitudinal axis in the retracted position, and the segment has a segment height H, H1, H2 perpendicular to the longitudinal axis. The radial tip has a tip length LT along the longitudinal axis being less than 75% of the segment length. The segment height at the base part is a first segment height H1, and the segment height at the radial tip is a second segment height H2. The second segment height H2 is approximately three times the first segment height H1 in FIG. 3. In another embodiment, the second segment height H2 is higher than the first segment height H1, and preferably at least two times higher than the first segment height H1. The radial tip 25B of FIG. 3 has a front face 76 facing away from the tool and a back face 78 facing towards the main part of the tool. The front face is inclining from the terminal end 10A inwards or backwards towards the back face. The segment has an angle v between the base face 77 and the front face of more than 90° so that the radial tip 25B is more acute than if the front face did not incline backwards. In FIG. 4, the front face of the radial tip inclines away from the base part, forming a less acute radial tip as the angle v is more than 90°. By having an acute radial tip as in FIG. 3, the segment and thus the tool are less likely to get stuck while cutting, grinding or milling into the casing 2, separating the upper part 4 from the lower part 5 (shown in FIG. 1). If the radial tip 25B has a large tip engaging the casing at the same time, it requires a higher amount of power than what can sometimes be provided to a tool several kilometres down the well. Furthermore, when separating the upper part of the casing from a lower part, the tool may be carrying the upper part when the segment has cut through the casing wall, and thus the segment can be stuck.

As shown in all the FIGS. 1-9 and especially in FIG. 3, the first segment has a base part 25A and a projecting part 25B projecting from the base part, forming the radial tip 25B. Thus, the first segment tapers from a base part into a terminal end, forming a radial tip of the projecting part. In operation, the radial tip contacts the inner face of the casing for selectively removing material from the casing, e.g. in order to separate/saw through the casing, and when the segment of an abrasive material is worn during the removal operation, the projecting part of the segment is merely reduced in size and new particles/diamonds in the segment are exposed, and the separation/removal operation can easily proceed with success as the remaining part of the projecting part of the segment is merely projected a bit further for compensating for the reduced size of the segment. When separating a sleeve or a second casing surrounding the first casing into two, the base part also becomes abrasive, removing further material from the first casing so that the projecting part having separated the first casing can project further to also separate the second casing. Thus, the base part, the radial tip and the projecting part are of abrasive material.

As can be seen in FIG. 6, the terminal end 10A of the radial tip 25B forms the abrasive edge 10. This is the same in FIG. 4 where the terminal end seems like a square face rather than a line or edge, but once the projection part projects from the tool housing 6, the segment is tilted, and then the terminal end forms the abrasive edge 10. The abrasive edge cuts into an element in the well from within the casing 2, and as the edge is worn the abrasive edge becomes larger, and the terminal end also machines into the adjacent parts of the cut in order to remove further material from the casing 2.

The segment 25 may also be the radial tip 25B tapering from a base part 25A arranged between the base face 77 and the radial tip 25B as shown in FIG. 5. Thus, the base part has approximately the same length as the base part and the segment length. The segment has a segment width W as shown in FIGS. 2, 6 and 7, and in FIG. 7 the radial tip also tapers in the circumferential direction of the tool into a smaller terminal end 10A than that of FIG. 6. In that way, the face in engagement with the casing wall or other element in the well to be machined is smaller and thus requires less power in order to rotate the segment(s) and the first housing part 7 than if the terminal end 10A was larger. When being several kilometres down the well, no more than 600 W may be available to power the tool, and thus such tapering may be the difference determining whether the tool is able to operate or not.

In FIG. 1, the downhole tubing intervention tool 1 further comprises a projection part 9 movable between a retracted position and a projected position in relation to the first housing part 7 of the tool housing 6. As shown in FIG. 2, the projection part 9 has a first end 18 and a second end 19. The second end 19 is movably connected with the first housing part, and the first end 18 is connected with the first segment 25, 25'. The tool further comprises a part activation assembly 11, as shown in FIGS. 8-10, for moving the projection part 9 between the retracted position and the projected position, e.g. by means of hydraulics. The projection part 9 is shown in its projected position in FIGS. 1, 8 and 9 but in its retracted position in FIG. 10 (dotted lines indicate the projected position). The projection part moves the segment (s) between the retracted and projected positions, and the projected position is never more than when the back face 78 of the segment is not perpendicular to the longitudinal axis of the casing but always inclining downwards so that the downhole tubing intervention tool 1 can always be retracted from the well by pulling the tool upwards. If the back face 78 was vertical, the downhole tubing intervention tool 1 would be at risk of getting stuck. The removing process removes material from the casing, and a triangular groove is made.

The projection part 9 shown in FIG. 2 has a second segment 25" arranged at a distance CD from the first segment 25, 25' along a circumference of the tool. The projection part of FIG. 2 has five segments where the third segment 25'" is also arranged at the distance CD from the second segment and the fourth segment 25"", which again is arranged at the distance CD from the fifth segment 25""", along the circumference of the tool. Thus, the projection part 9 has several segments connected to the first end 18. The projection part 9 has a part extension LA, and the segment length LS of the first segment extends along the part extension, and the segment height H extends perpendicularly to the part extension in a radial direction R (shown in FIG. 1) of the tool. By having a distance between the segments, less contact with the inner face of the casing is obtained than compared with one larger segment covering the same area as five segments. Thus, less power is required to rotate the projection part, and the particles created from the material removing process can easily move away from the contact area through the space between the segments.

In FIG. 1, the projection part 9 is pivoting between the retracted position and the projected position. The projection part 9 thus has a pivot point 33 as shown in FIGS. 2 and 9. In FIG. 9, the part activation assembly 11 comprises a piston housing 17 arranged in the first housing part 7 and comprising a piston chamber 14, and a piston member 15 arranged inside the piston chamber for moving the part between the retracted position and the projected position. The piston member is movable in the longitudinal direction of the downhole tool and has a first piston face 16, and the piston member is capable of applying a projecting force on the projection part by hydraulic pressure applied on the first piston face and thereby moving the piston in a first direction, applying an axial force converted into a dynamic cutting force through a rolling CAM contact in pos. 31, 32 and pivot point 33. Hydraulic fluid from the pump is pumped into a first chamber section of the chamber 14 through a first fluid channel 18B, applying a hydraulic pressure on the first piston face 16, and the piston moves in a first direction, applying an axial force on the projection part 9. The axial force is converted into a dynamic cutting force through the pivot point 33 and the terminal end 10A of the radial tip 25B.

FIG. 8 shows a part of another embodiment of the downhole tubing intervention tool 1 where the part activation assembly 11 also comprises a piston housing 17 arranged in the first housing part 7 and a piston member 15 arranged inside a piston chamber 14 for moving the projection part between the retracted position and the projected position. However, the piston member 15 is movable in a direction perpendicular to the longitudinal direction of the downhole tool. The piston member is also capable of applying a projecting force on the projection part by hydraulic pressure applied on the first piston face 16, moving the piston member in a first direction radially outwards from the tool housing 6. The downhole tubing intervention tool 1 comprises an anchoring section 22 having four anchors 62 extendable from the tool housing 6 for anchoring the tool in the casing 2.

The downhole tubing intervention tool 1 may further comprise a stroking unit (not shown), such as a stroking tool, providing a movement of the first housing part 7 and the first segment 25 in the projected position along a longitudinal extension of the casing 2 or the well tubular metal structure 2. The stroking unit is arranged between the anchoring section 22 and the first housing part 7 so as to be able to project the first housing part 7 from the anchoring section/anchor section 22. Thus, when the downhole tubing intervention tool 1 is submerged into the casing/well tubular metal structure 2, and the anchoring section 22 of the downhole tool is hydraulically activated to anchor the first housing part 7 of the downhole tubing intervention tool 1 in relation to the well tubular metal structure 2, the first segment 25 removes material from the well tubular metal structure 2 along a circumference and the longitudinal extension of the well tubular metal structure. In that way, a section of the well tubular metal structure is removed from the well tubular metal structure, thereby grinding a part of the well tubular metal structure into insignificantly small pieces/particles, creating or re-creating annular isolation. The section removed from the well tubular metal structure extends all the way around the circumference of the well tubular metal structure and may have a length along the longitudinal extension of the well tubular metal structure of more than 0.5 metre, preferably more than 1 metre, and even more preferably more than 5 metres. Thus, removing a section of the casing/well tubular metal structure 2 provides access to the annulus surrounding the well tubular metal structure for creating or re-creating annular isolation, i.e. zone isolation in the annulus, or cement can be poured into the annulus, e.g. for Plug and Abandonment (P&A) operations, or an annular barrier may be arranged and expanded opposite the section to provide zone isolation in the annulus.

As shown in FIG. 1, the downhole tubing intervention tool 1 is a downhole tubing separation tool separating an upper part 4 of the casing 2 from a lower part 5 of the casing by abrasively machining the casing from the inside of the casing, e.g. for producing a slightly bevelled cut.

When the projection part is projected to press against an inner face of the casing 2 or drill pipe and is simultaneously rotated by the motor through the rotatable shaft 12, the abrasive edge 10 is capable of milling or grinding through the casing or drill pipe without producing chips but merely particles. Thereby, it is obtained that an upper part 4 of the casing can be separated from a lower part 5 of a casing by cutting the casing from within without the use of explosives. In FIG. 9, fluid from the pump is supplied through a circumferential groove 27 fluidly connected with a second fluid channel 28 in the second housing part 8. Thus, the fluid from the second fluid channel 28 is distributed in the circumferential groove 27 so that the first fluid channel is always supplied with pressurised fluid from the pump while rotating. The circumferential groove 27 is sealed off by means of circumferential seals 29, such as O-rings alone or slipper seals combined with O-rings acting as an energizer to establish a sealing surface on both sides of the circumferential groove 27. The piston member 15 moves in the longitudinal direction of the tool 1 inside the piston chamber and divides the chamber 14 into a first chamber section 26A and a second chamber section 26B. When the piston member moves in the first direction, a spring member 40 abutting the second piston face 17B opposite the first piston face 16 is compressed. As the spring member is compressed, so is the second chamber section, and the fluid therein flows out through a fourth channel 44 fluidly connected with the channel 28. The spring member, which is a helical spring surrounding part of the piston member arranged in the second chamber section 26B, is thus compressed between the second piston face 17B and the piston chamber 14. The piston member has a first end 30 extending out of the piston housing 17 and engaging the projection part by having a circumferential groove 31 into which a second end 32 of the projection part extends. The second end of the projection part is rounded to be able to rotate in the groove. The projection part is pivotably connected with the first housing part 7 around a pivot point 33. In the other and second end 34 of the piston member, the piston member is connected with the shaft 12. When the piston member is moved in the first direction, a space 45 is created at the second end 34 of the piston member. This space 45 is in fluid communication with the well fluid through a third channel 35, which is illustrated by a dotted line. In this way, the piston member does not have to overcome the pressure surrounding the tool in the well. The second end 34 of the piston member is provided with two circumferential seals 36 in order to seal off the piston chamber from the dirty well fluid or well contaminants. When the machining operation is over, the hydraulic pressure from the pump is no longer fed to the first channel, and the spring member forces the piston member 15 in a second direction opposite the first direction along the longitudinal direction L of the tool, as indicated in FIG. 9.

When seen in cross-section, the projection part has an abrasive edge 10 forming an outermost point of the projection part when the projection part is in its projected position, so that the abrasive edge is the first part of the projection part to abut the inner face of the casing 2 or drill pipe. In this way, the casing or drill pipe can be machined or separated from within the casing or drill pipe. When seen in the cross-sectional view of FIG. 9, the projection part 9 thus moves from a retracted position in which the projection part is substantially parallel to the longitudinal direction of the tool to the projected position, as shown, in which the projection part has an angle x to the longitudinal direction L of the tool. Thus, the abrasive edge of the segment 25 projects radially from the round tool housing 6. As shown in the cross-sectional view of FIG. 9, the projection part is L-shaped, creating a heel part 50, and is pivotably connected around the pivot point 33 in the heel part. Thus, the projection part 9 has a first end 18 with the segment 25 and a second end 19 cooperating with the piston member. Between the first and second ends, in a pivoting point, a pin 41 penetrates a bore 42 in the projection part. In FIG. 9, the tool is shown with only one projection part for illustrative purposes. However, in another embodiment the tool has three projection parts arranged 120° apart from each other. The piston member is substantially coaxially arranged in the tool housing and has two circumferential seals 43, such as O-rings.

FIG. 10 shows another embodiment of a downhole tubing intervention tool 1. Like the embodiment described in relation to FIG. 9, a projection part 9 is pivotably connected with the first housing part 7 and has an abrasive edge 10 in a first end 18. The projection part 9 is movable between a retracted position and a projected position in relation to the tool housing 6.

For rotating the rotatable cutting head 110, the downhole tubing intervention tool 1 comprises a rotatable shaft 12 rotated by a motor 20. The rotatable shaft 12 extends through the second housing part 8 and the first housing part 7, and in the first housing part the rotatable shaft provides a rotational input for a gearing assembly 53. For moving the projection part 9 between the retracted position and the projected position, the downhole tubing intervention tool 1 comprises a projection part activation assembly 111. The projection part activation assembly 111 comprises a piston housing 113 arranged in the first housing part 7 and comprising a piston chamber 114. A piston member 115 is arranged inside the piston chamber and engages with an activation element 55 adapted to move the projection part 9 between the retracted position and the projected position. The piston member 115 is movable in a longitudinal direction of the tool and has a first piston face 116. Hydraulic fluid from the hydraulic pump 21 is pumped through a first fluid channel 118 into the piston chamber 114, applying a hydraulic pressure on the first piston face 116. The piston moves in a first direction, and the piston member applies a projecting force on the projection part 9. When the piston member moves in the first direction, a spring member 140 abutting the activation element 55 is compressed. To retract the projection part 9 from the projected position (indicated by dotted lines), the supply of hydraulic fluid to the piston chamber 114 is terminated, and the spring member 140 forces the piston member 115 in a second direction opposite the first direction along the longitudinal direction L of the tool.

The spring member 140 may also be arranged inside the piston housing 113, thereby providing a retraction force of the projection part. When the piston member moves in the first direction, a spring member 140 is compressed in the piston housing. To retract the projection part from the projected position, the supply of hydraulic fluid to the piston chamber 114 is terminated, and the spring member 140 forces the piston member 115 in a second direction opposite the first direction along the longitudinal direction 37 of the tool.

In FIG. 10, the activation member/element 55 has the shape of an L-profile of which a first end 551 engages with a recess 561 in the outer sleeve of the projection part 9. The first end 551 of the activation member is rounded in order for the recess 561 to be able to rotate around the first end 551 when the projection part is moved into the projected position. It is envisaged by the skilled person that the projection part activation assembly 111 may be constructed using various other principles without departing from the invention. The activation member may be adapted to move the projection part from the retracted position to the extended position only. The spring member 140 may thereby be adapted to provide a retraction force directly to the projection part to move the projection part from the projected position to the retracted position.

FIG. 11 shows a cross-sectional view of an alternative anchor section 22 to the anchor section shown in FIG. 1 or 8 for anchoring the second housing part 8 of the tool housing 6 in relation to the casing 2. The anchor system/section 22 comprises a plurality of anchors 221 which may be extended from the second housing part 8, as shown in FIG. 11. Each of the anchors 221 comprises two anchor arms 222, 223 pivotally connected at a first pivot point 230; a first anchor arm 222 pivotally connected to the second housing part 8 at a second pivot point 231 and a second anchor arm 223 pivotally connected to a piston sleeve 224 provided in a bore 226 in the second housing part 8, around the rotatable shaft 12. The piston sleeve 224 is thus an annular piston. The piston sleeve 224 is under the influence of a spring member 225, providing a fail-safe system ensuring that the plurality of anchors 221 are retracted in order to be able to retrieve the tool in the event that power is lost, or another breakdown occurs. In FIG. 11, the anchors 221 are extended, and the spring member 225 is compressed by the piston sleeve being forced in a first direction away from the projection part by a hydraulic fluid supplied under pressure to the piston chamber 228, thereby acting on a piston face 227 of the piston sleeve 224. When the supply of hydraulic fluid is terminated, the pressure on the piston face 227 decreases, and the spring member displaces the piston sleeve in a second direction opposite the first direction, whereby the anchors 221 are retracted.

The hydraulic fluid for displacing the piston sleeve 224 is supplied by a hydraulic system separate from the hydraulic system used for supplying the hydraulic pressure for moving the projection part between the retracted position and the projected position. By using two separate hydraulic systems, the projection part and the anchors may be operated independently of one another. For example, the projection part may be retracted if problems occur during the cutting operation, without affecting the position of the tool in the well. Thus, the tool remains stationary in the well, and the projection part may be projected once again to continue the interrupted cutting procedure. Had the tool not been kept stationary during retraction of the projection part, it would be difficult to determine the position of the initiated cutting, and the cutting procedure would have to start all over again at a new position. When having to start all over, the abrasive edge 10 or bits on the projection part may have been abraded too much for the tool to be able to cut through the casing 2 at the new position, and the tool may therefore have to be retracted from the well to replace the segment of the projection part in order to be able to cut all the way through the casing.

To secure that the tool does not remain anchored in the well due to a power loss or malfunction of one of the hydraulic systems, the hydraulic system of the anchor section comprises a timer for controlling the supply of hydraulic fluid to the piston chamber 228. When the projection part is retracted, the timer registers/records the time elapsed. Depending on operation-specific parameters, the timer may be set to retract the anchors at any time after retraction of the projection part, preferably between 15 and 180 minutes, and more preferably between 30 and 60 minutes after retraction of the projection part. When the set time has lapsed, the timer activates a valve which controls the pressure in the piston chamber 228. As the valve is activated, the pressure in the piston chamber drops, and the piston member displaces the piston sleeve to retract the anchors. The valve control comprises a battery, and activation of the valve may be powered by the battery if the power to the tool is cut. The anchor arm 222 has an end surface facing the inner face of the casing 2 when being in the projected position, which is serrated to improve the ability of the anchor arm 222 to engage with the inner face of the casing. The tool comprises a second pump for driving the separate hydraulic system for activating the anchor system. Thus, the shaft around which the piston sleeve extends may have a fluid channel for supplying fluid to the projection of the projection part.

The invention furthermore relates to a downhole system 100, shown in FIG. 1, comprising a well tubular metal structure and the abovementioned downhole tubing intervention tool for arrangement in the downhole system.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing 2, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole tubing intervention tool for submerging into a casing in a wellbore and for selectively removing material from within the casing, the tool extending in a longitudinal direction, comprising:

a tool housing having a first housing part and a second housing part, a rotation unit, arranged in the second housing part, and a rotatable shaft rotated by the rotation unit for rotating at least a first segment of abrasive material being connected with the first housing part and where the abrasive material comprises abrasive grains and a binder forming an abrasive edge, where the abrasive material is configured to expose new abrasive grains as the abrasive material wears during use, wherein the first segment is movable between a retracted position and a projected position in relation to the first housing part of the tool housing, wherein the first segment tapers in a radial direction away from the longitudinal direction from a base part into a terminal end, forming a radial tip.

2. A downhole tubing intervention tool according to claim 1, wherein the abrasive grains comprise diamond, Cubic Boron Nitride, aluminium oxide (corundum), silicon carbide, tungsten carbide or ceramic.

3. A downhole tubing intervention tool according to claim 1, wherein the downhole tubing intervention tool comprises a second segment arranged at a distance from the first segment along a circumference of the tool.

4. A downhole tubing intervention tool according to claim 1, wherein the radial tip forms the abrasive edge.

5. A downhole tubing intervention tool according to claim 1, wherein the first segment has a segment length along the longitudinal direction in the retracted position and a segment height perpendicular to the longitudinal axis, the radial tip having a tip length along the longitudinal axis being less than 75% of the segment length.

6. A downhole tubing intervention tool according to claim 5, wherein the first segment has a segment width extending along the circumference of the tool.

7. A downhole tubing intervention tool according to claim 1, wherein the tool further comprises a projection part movable between a retracted position and a projected position in relation to the first housing part of the tool housing, the projection part having a first end and a second end, the second end being movably connected with the first housing part, and the first end being connected with the first segment, and the tool further comprises a part activation assembly for moving the part between the retracted position and the projected position.

8. A downhole tubing intervention tool according to claim 7, wherein the projection part has several segments connected to the first end.

9. A downhole tubing intervention tool according to claim 7, wherein the projection part has a part extension, the segment length of the first segment extends along the part extension, and the segment height extends perpendicularly to the part extension in a radial direction of the tool.

10. A downhole tubing intervention tool according to claim 7, wherein the part activation assembly comprises:

a piston housing arranged in the first housing part and comprising a piston chamber, and a piston member arranged inside the piston chamber for moving the part between the retracted position and the projected position, the piston member being movable in the longitudinal direction of the downhole tool and having a first piston face, the piston member being capable of applying a projecting force on the part by applying hydraulic pressure on the first piston face and moving the piston in a first direction.

11. A downhole tubing intervention tool according to claim 7, wherein the part activation assembly comprises:

a piston housing arranged in the first housing part and comprising a piston chamber, and a piston member arranged inside the piston chamber for moving the projection part between the retracted position and the projected position, the piston member being movable in a direction perpendicular to the longitudinal direction of the downhole tool and having a first piston face, the piston member being capable of applying a projecting force on the part by applying hydraulic pressure on the first piston face and moving the piston in a first direction.

12. A downhole tubing intervention tool according to claim 1, wherein the downhole tubing intervention tool is a downhole tubing separation tool separating an upper part of the casing from a lower part of the casing by abrasively machining the casing from within.

13. A downhole tubing intervention tool according to claim 1, further comprising an anchor section comprising at least one anchor extendable from the tool housing for anchoring the tool in the casing.

14. A downhole tubing intervention tool according to claim 1, further comprising a driving unit comprising wheels on wheel arms for propelling the tool forward in the well.

15. A downhole tubing intervention too according to claim 1, wherein the first segment is pivotably mounted about a pivot axis for movement between the retracted and projected positions and also has a longitudinal axis that runs through the pivot axis, wherein the tapered portion is flared outwardly at an angle relative to the longitudinal axis of the first segment.

16. A downhole tubing intervention too according to claim 1, wherein the first segment is pivotable between the retracted and projected positions and has only one axis of rotation.

17. A downhole tubing intervention tool for submerging into a casing in a wellbore and for selectively removing material from within the casing, the tool extending in a longitudinal direction, comprising:

a tool housing having a first housing part and a second housing part, a rotation unit, arranged in the second housing part, and a rotatable shaft rotated by the rotation unit for rotating at least a first segment of abrasive material being connected with the first housing part and where the abrasive material comprises abrasive grains and a binder forming an abrasive edge, where the abrasive material is configured to expose new abrasive grains as the abrasive material wears during use, wherein the first segment is movable between a retracted position and a projected position in relation to the first housing part of the tool housing.

18. A downhole tubing intervention too according to claim 17, wherein the first segment is pivotable between the retracted and projected positions and has only one axis of rotation.

19. A downhole tubing intervention too according to claim 17, wherein the first segment is pivotably mounted about a pivot axis for movement between the retracted and projected positions and also has a longitudinal axis that runs through the pivot axis, wherein a tapered portion of the first segment is flared outwardly at an angle relative to the longitudinal axis of the first segment.

* * * * *